United States Patent [19]

Pao et al.

[11] Patent Number: 4,737,267

[45] Date of Patent: Apr. 12, 1988

[54] OIL SHALE PROCESSING APPARATUS AND METHOD

[75] Inventors: Sun-Sea Pao; Jerry V. Fox; John S. Rendall, all of Albuquerque, N. Mex.

[73] Assignee: Duo-Ex Coproration, Albuquerque, N. Mex.

[21] Appl. No.: 929,722

[22] Filed: Nov. 12, 1986

[51] Int. Cl.[4] ..... C10G 1/00; C10G 1/08

[52] U.S. Cl. ..... 208/432; 208/427; 208/97; 208/952; 208/424

[58] Field of Search ..... 208/952, 424, 308, 97, 208/113, 432, 428, 427

[56] References Cited

U.S. PATENT DOCUMENTS

| | | | |
|---|---|---|---|
| T861,044 | 4/1969 | Hemminger et al. | 208/952 |
| 3,932,266 | 1/1976 | Sze et al. | 208/424 X |
| 4,251,346 | 2/1981 | Dry et al. | 208/952 X |
| 4,334,977 | 6/1982 | Derbyshire et al. | 208/952 |
| 4,374,015 | 2/1983 | Brulé | 208/952 X |
| 4,469,583 | 9/1984 | Case et al. | 208/424 X |
| 4,486,295 | 12/1984 | Inooka | 208/97 X |
| 4,541,913 | 9/1985 | Urquhart et al. | 208/952 X |
| 4,609,455 | 9/1986 | Weimer et al. | 208/952 X |

*Primary Examiner*—Helen M. S. Sneed
*Assistant Examiner*—Glenn Caldarola
*Attorney, Agent, or Firm*—Thomas E. Schatzel

[57] ABSTRACT

A method and apparatus for the recovery of bitumen oils from oil shale. The method comprises crushing the oil shale to a predetermined particle size and mixing with an organic solvent to form a slurry. The slurry is then subjected to supercritical temperatures and pressures whereby the kerogen materials break down into bitumen oils which solubilize in the solvent. The liquid and solids are separated and the solid components are further treated under supercritical temperatures and pressures to yield further bitumen oils. The extracted bitumen oils are separated from solvent by fractionation, and upgraded by removing an asphaltenes residue. Off-gases and asphaltenes residue from the system are burned in a limestone fluidized bed combustor, which results in environmentally acceptable emissions and supplies process heat and power. The apparatus includes a high pressure autoclave-type vessel with an internal venturi draft tube, and a plurality of high pressure decantation vessels with internal lamellae thickeners.

20 Claims, 3 Drawing Sheets

OIL SHALE PROCESSING APPARATUS AND METHOD

BACKGROUND OF THE INVENTION

1. Field of the Invention

This invention relates to a process for extracting bitumen from oil shale, and more particularly, to a process and apparatus for extracting bitumen using supercritical solvent techniques.

2. Description of the Prior Art

Oil shale deposits are very extensive worldwide, and found in all major continents. Estimated oil shale reserves could provide hundreds or thousands of times more synthetic crude than conventional crude resources. In the United States alone, it is estimated that over seven trillion barrels of oil are contained in oil shale reserves. These reserves are found mainly in the Green River formation of Utah, Colorado and Wyoming, and in the Devonian-Mississippian Eastern Shale Deposits between the Appalachian and Rocky Mountains.

Efforts to utilize this resource fall primarily into two classes: Retorting processes and solvent extraction processes. Retorting may be further subdivided into in-situ and surface processes. Both retorting processes and existing solvent extraction processes require the addition of large amounts of heat to convert the kerogen in the oil shale to bitumen. Retorting requires high temperatures, on the order of 950° F., and surface retorting utilizing gaseous heat transfer media require very large processing vessels for efficient production.

An environmental problem associated with retorting processes is a large (up to 3%) increase in volume of spent shale for disposal compared to the original shale ore. This is due in part to the high temperature vaporization of the shale oil within the shale ore particles being processed. This rapid vaporization process swells the particles and results in a net volume increase. This prohibits easy disposal of the spent shale in the original mine.

Retort reaction times and conditions must be carefully controlled to avoid converting the bitumen to lower molecular weight products and unusable residual carbon. Hydrocarbons in oil shale are in the form of kerogen. Kerogen is converted to lower molecular weight hydrocarbons ranging from methane to bitumen when heated to temperatures above 350° C. Retorting processes normally operate near 500° C. Extended reaction time leads to conversion of primary bitumen products to other lower molecular weight products and residual carbon. Retorting also typically produces unacceptable environmental emissions, relatively low yields of bitumen and requires heavy water usage.

The challenge in the processing of oil shale is to limit the production of gas to the amount required to fuel the process, while at the same time, minimizing the production of carbon which represents lost resource. Thus, it is desirable to recover the converted kerogen (bitumen) without the conversion to secondary lighter products. Upgrading to the desired final products is more efficient in downstream processing.

Separation of shale oil from spent shale without vaporization implies using solvent extraction. Solvent extraction is based on dissolving the converted hydrocarbon products under reaction conditions. Conversion of kerogen results in disintegration of the shale particles. The extent of this disintegration will be a primary consideration in the design of an oil shale process.

Solvent extraction methods heat the shale in the presence of a solvent to temperatures of about 100° F.–1000° F. and may require hydrogenation to achieve the conversion. Solvent processes generally exhibit better yields than the retorting processes, and a number of variations of the solvent process exist. However, the prior art oil shale solvent processes have problems in separating the spent shale particles from the solvent and bitumen. None use supercritical pressure to maintain the solvents in the fluid state at the elevated temperatures.

Numerous patents have been granted for inventions relating to bitumen recovery from oil shale, chiefly retorting and solvent recovery methods. Retorting processes are disclosed in U.S. Pat. Nos. 2,601,257, issued to Buchan; 3,921,193, issued to Duke; and 4,410,415, issued to Seitzer. Processes relying on means for dissolving the kerogen are disclosed in U.S. Pat. Nos. 3,017,342, issued to Bulat, et al; 3,497,005, issued to Pelopsky; 4,130,474, issued to Anthony; 4,151,067, issued to Grow; and 4,108,760, issued to Williams, et al. A process involving retorting and some aspects of solvent techniques is disclosed in U.S. Pat. No. 4,454,017, issued to Swanson.

None of the processes of the prior art have overcome the difficulties associated with the existing retorting and solvent extraction processes.

SUMMARY OF THE INVENTION

It is therefore an object of the present invention to provide a method for extracting a high yield of bitumen from oil shale by converting a high percentage of kerogen to bitumen.

It is a further object of the present invention to provide an environmentally and economically viable method of extracting bitumen from oil shale.

It is another object of the present invention to provide a method for the extraction of bitumen from oil shale which minimizes water use.

It is another object of the present invention to provide a method for the extraction of bitumen from oil shale which utilizes relatively low temperatures.

It is another object of the present invention to provide a method for the extraction of bitumen from oil shale which yields a synthetic crude oil substitute.

Briefly, a preferred embodiment of the process of the present invention is a method for an intermediate to low temperature solvent extraction of bitumen from oil shale, utilizing a solvent leaching step under temperature and pressure conditions up to, and including, supercritical conditions for the solvent. Crushed shale plus solvent is fed into a slurry mixer where water associated with the shale is eliminated, and the process of converting kerogen to bitumen is begun. The slurry is transferred to an autoclave wherein moderate temperatures and elevated pressures are used to convert substantially all of the kerogen into soluble bitumen. The bitumen is charged to a pressurized extraction vessel wherein the soluble bitumen is separated from the remaining components of the slurry. The supercritical conditions facilitate the separation process.

The remaining shale is washed with solvent in a series of extraction vessels, wherein additional bitumen is extracted and separated from the shale. Once this has been accomplished, the bitumen extract is drawn off and the solvent is distilled and recycled. The bitumen oils are then subjected to an upgrading step to remove asphaltenes and fines. This step yields one or two fractions of crude oil and an asphaltenes residue. The residue also may be sold, for example, for asphalt production, or it may be burned to supply process power and heat. The spent shale is cooled with a water spray which also extracts remaining solvent. The solvent and water are separated and recycled.

A preferred embodiment of the apparatus of the present invention includes at least one autoclave wherein high pressure leaching takes place to convert kerogen to bitumen. The autoclave may include an internal venturi draft tube to keep the slurry mixed. A pressurized extraction vessel, having a plurality of internal lamellar thickeners, continues the conversion process and acts to solubilize the converted bitumen. The apparatus further includes a series of pressurized solvent washing shale decanters in which shale moves countercurrent to the solvent. Also included are distillation columns, settling tanks and a plurality of pumps and heat exchangers to transfer and recycle components. A limestone fluid bed combustor system provides process heat and power.

It is an advantage of the present invention that high yields of bitument oils are obtained.

It is another advantage of the present invention that highly pure bitumen products are obtained, including a synthetic crude oil substitute.

It is yet another advantage of the present invention that a minimum of environmental contamination occurs.

It is another advantage of the present invention is that water usage is minimized.

These and other objects and advantages of the present invention will no doubt become obvious to those of ordinary skill in the art after having read the following detailed description of the preferred embodiments as illustrated in the various drawing figures.

DETAILED DESCRIPTION OF THE PREFERRED EMBODIMENT

Figure 1:
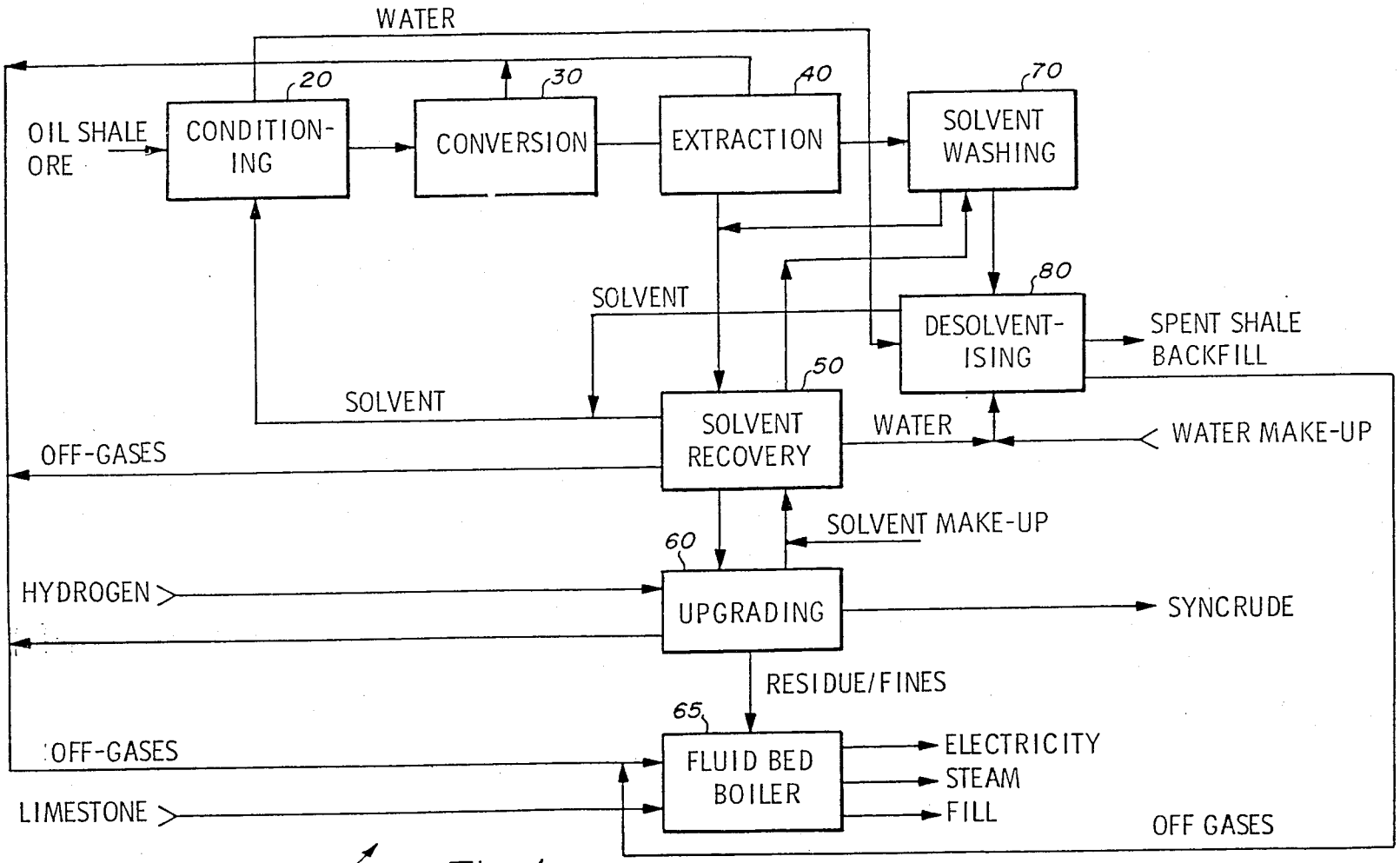
FIG. 1 is an overall block diagram of the method for extracting bitumen oils from oil shale in accordance with the present invention.

FIG. 1 is a schematic block diagram illustrating a process of the present invention for converting oil shale to bitumen oils, and is designated by the general reference number 10. The process 10 begins with the introduction of mine-run rock which may range in size up to forty inches to a conditioning means 20 wherein the ore is broken down to a size range of less than one inch. The crushed shale is fed to a slurry mixer and slurried with a hydrocarbon solvent with heat added in an amount sufficient to remove moisture associated with the shale. Mechanical agitation within the mixer, together with the solvent action, begins the breakdown of kerogen into free bitumen. This slurry is also brought up to solvent supercritical temperatures and pressures in the conditioning means 20.

Substantially all of the kerogen is broken down in a primary bitumen conversion means 30 wherein the slurry is leached at sufficiently elevated temperature and pressure conditions to cause pyrolysis of the kerogen in the shale. The conditions are controlled to prevent pyrolysis beyond that necessary to produce the bitumen. Slurry from the conversion means 30 is drawn off and enters an extraction means 40 wherein the bitumen oils are solubilized in the solvent to form an extract, and the extract separates from remaining components in the slurry. The extract enters a solvent recovery means 50 wherein solvent is removed to yield bitumen oils. The bitumen oils are upgraded in an upgrading means 60 and separated into a residue, comprising asphaltenes and fines, and a pipelineable synthetic crude oil.

A number of processes may be employed as the upgrading means 60 to hydrogenate and/or remove fines and asphaltenes residue from the bitumen oil. These include an asphalt residual treatment utilizing a fluid catalytic cracker to remove carbon residue from the fines (with the proprietary name ART), solvent extraction at, above or below supercritical conditions and hydrovisbreaking, with or without catalyst addition and with or without solvent deasphalting. In the process 10, the upgrading means 60 comprises hydrovisbreaking.

Upgraded syncrude exits the means 60 as the primary product of the process 10, and the asphaltenes residue enter a fluid bed boiler means 65. Within the fluid bed boiler means 65, the fines are removed in a bag house or scrubber (not shown). The asphaltenes are burned with the fluid bed boiler means 65 to supply process heat and power. The fluid bed boiler means 65 also accepts a flow of limestone to capture sulfur so that emissions will be environmentally acceptable.

Shale from which the bitumen has been extracted is transferred from the extraction means 40 to a solvent washing means 70. Within the solvent washing means 70, the shale is washed with solvent to further solubilize the remaining bitumen. Fresh solvent flows countercurrently to the shale in the solvent washing means 70, which utilizes up to four pressure decanters in series for maximum efficiency. Continued elevated pressure and temperature conditions within the decanters of the means 70 acts to extract any remaining bitumen from the shale. Spent shale from the solvent washing means is transferred to a desolventising means 80 wherein the shale is cooled with a water spray. The cooling water and remaining solvent are recovered, separated and recycled. Damp shale exits the means 80 to be used as fill.

Solvent recycling will be greatly facilitated if the solvent chosen is one of the constituents of the bitumen oils extracted from the oil shale. By choosing such a solvent, that required to extract the bitumen oils can be maintained by merely extracting the necessary make-up solvent in combination with the bitumen extract, and then separating the mixture.

Separation of the solvent from the bitumen extract in the solvent recovery means 50, and from water in the desolventising means 80, can be performed for a wide range of light hydrocarbons having specific gravities of less than nine-tenths (0.9). Applying these criteria to the selection of solvent, toluene is the initial preferred hydrocarbon for use as a solvent in the extraction of oil shale similar in composition to that in the Green River formation. Ultimately, the solvent would comprise a recycle stream within approximately the boiling range of toluene. Hydrocarbons with a boiling range of 80° C.–200° C. at atmospheric pressure are good solvents.

Figure 2:
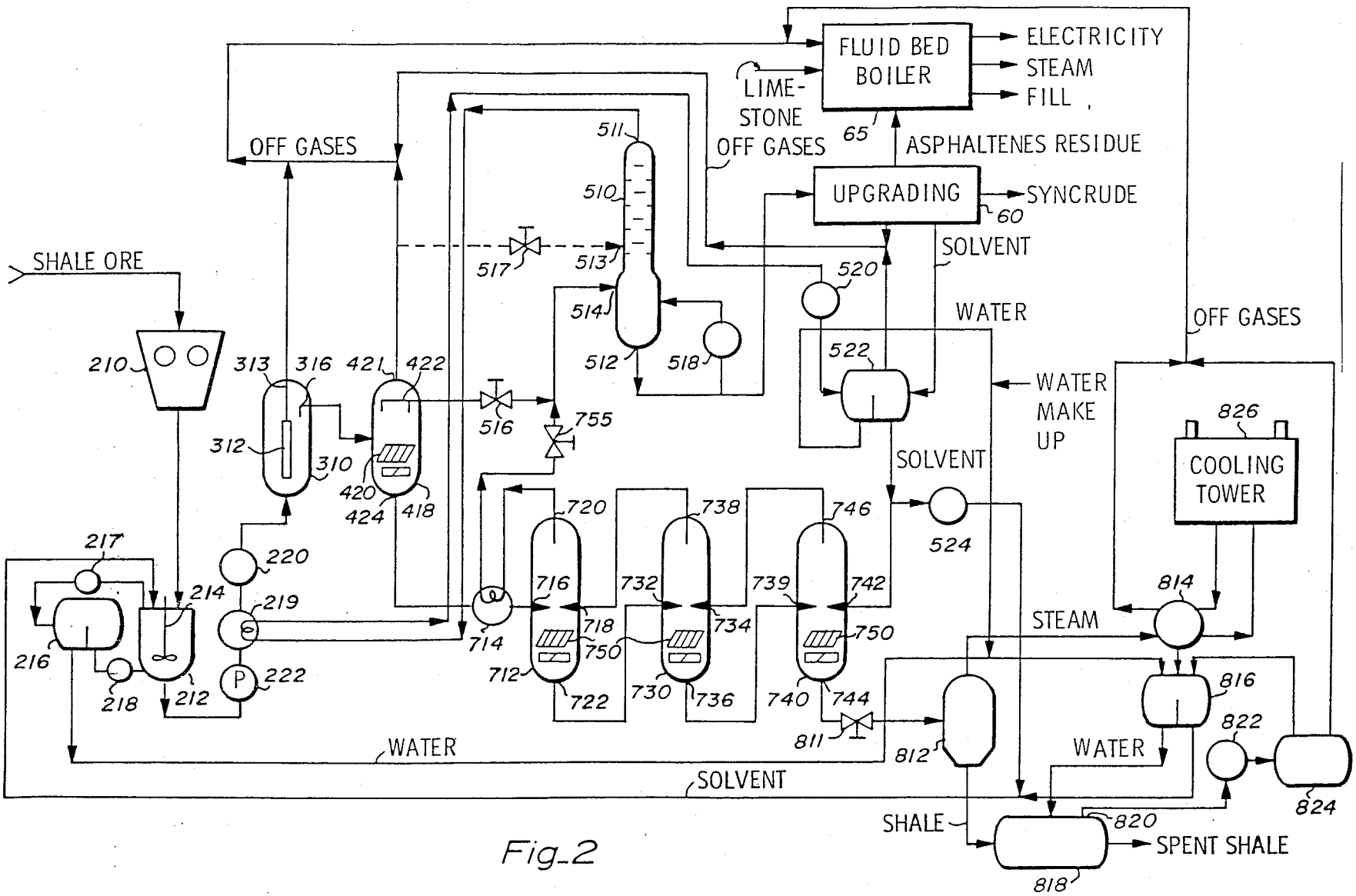
FIG. 2 is a detailed schematic diagram of the method of FIG. 1.

A detailed implementation of the process of FIG. 1 is illustrated in FIG. 2. The process illustrated in FIG. 2 is specifically adapted to process oil shale similar in composition to that found in the Green River formation of Utah, Colorado and Wyoming.

The conditioning means includes a mill crusher 210 which receives a quantity of mine-ore and crushes it to less than one inch particles. The crushing operation increases the accessible surface area per volume of shale, and thus, increases the efficiency of the extraction process. The exact size needed to obtain the desired decrepitation kinetics in the conversion step will depend on the kerogen and/or mineralogical content of the ore. Particle size may also be adjusted.

Crushed shale exists the mill 210 and enters a slurry mixer 212 which is a cylindrical vessel with a conical bottom for receiving the flow of crushed shale. The mixer 212 also receives a flow of an organic solvent, for example, toluene, which is at least partially and preferrably substantially supplied by recycling solvent from the solvent recovery means and solvent washing means. The weight ratio of solid shale to liquid solvent is in the range of 1/1 to 1/3.

At start-up, fresh solvent is supplied to the slurry mixer 212 and is heated to a temperature just below the boiling point for the solvent chosen, e.g. to about 185° F. for toluene. Additional heat may be directly added to the slurry, as required. The solvent should be hot enough to strip out water from the slurry. A mechanical stirrer or rake 214, formed within the slurry mixer 212 aids in forming the slurry. Coupled to the mixer 212 is a separator 216 which receives a mixture of solvent and water from the mixer 212. Prior to entering the separator 216, the solvent water mixture passes through a condenser 217 wherein the mixture is cooled sufficiently to condense it. The separator 216 separates the cooled mixture into a water component and a solvent component. The solvent component is returned to the mixer 212, after reheating in a heater 218, to again contact the oil shale to form the slurry, and the water component may be recycled through the desolventising means. The hot solvent and the separator 216 function to remove any moisture present in the crushed ore.

After a residence time of approximately ten minutes, the slurry exits the bottom of the slurry mixer 212 and is pumped through a preheat heat exchanger 219 and a heat exchanger 220. A pump 222, intermediate to the slurry mixer 212 and the preheat heat exchanger 219 raises the pressure of the slurry to about 1000 psig. The preheat heat exchanger 219 receives heated solvent from the solvent recovery means and transfers a portion of this heat to the incoming slurry. The temperature of the slurry is raised thereby to about 450° F. The heat exchanger 220 further heats the incoming slurry to a temperature which is within the supercritical range for the solvent chosen, and in the case of toluene, to between about 600° F. and 850° F. Other hydrocarbon solvents may have supercritical ranges of 650° F. to 850° F. and 600 to 1500 psi. The supercritical temperature is that temperature about which two phases, liquid and gas, do not exist separately, no matter what the pressure. At these temperatures only a single phase, or dense phase fluid, exists which is half way between a gas and a liquid. Keeping the extract at a single phase greatly facilitates separation of the shale from the oil. If the solvent is allowed to turn to gas, the separation becomes more difficult. The supercritical temperature used must also be great enough to allow the kerogen to be converted to bitumen. The pressure used at these supercritical temperatures is that pressure which achieves the optimum fluid properties such as density and fluid viscosity. A typical density would be below 0.5 grams per c.c. The optimum fluid properties and densities will vary depending on the type of oil shale used.

The conversion means includes an autoclave 310 in which substantially all of the kerogen in the slurry is converted to bitumen by pyrolysis. Under the elevated temperature and pressure conditions within the autoclave 310, i.e. above 750° F. and typically above 1000 psig, the kerogen, typically comprising long chain polycyclic hydrocarbons, breaks down into shorter chain bitumen molecules. The autoclave 310 may be constructed in a variety of configurations and may be operated semi-automatically or automatically, batch, continuously or semi-continuously, and in the process, the autoclave is operated in a continuous mode.

The autoclave 310 is a capsule-shaped pressure vessel and includes an internal venturi draft tube 312 to keep the slurry in suspension as it flows within the autoclave 310. In the process the autoclave 310 is an unstirred-type, but stirred autoclaves may be used as well. In the case of a stirred autoclave, the venturi draft tube 312 may be wholly or partially omitted. The venturi draft tube 312 acts to circulate particles containing kerogen until they have fully reacted and are decrepitated, a process which requires a residence time of approximately between one and twenty minutes. The shorter residence times are preferred, as short residence times inhibit coke formation and gas production, and result in the maximum yield of liquid bitumen. During the reaction, the internal venturi draft tube 312 serves to keep the contents mixed and also to disengage off-gases generated by the pyrolysis reaction. Off-gases exit the autoclave 310 via vapor outlet 313. The products of the autoclave 310 comprise solvent plus bitumen oils and spent shale, plus some unreacted oil shale, which are drawn off of a product outlet 316 and charged to the extraction means.

Within the extraction means, the slurry is charged to a high pressure extraction vessel 418. The interior of the vessel 418 is maintained at the same supercritical conditions as the autoclave 310, i.e. approximately 750° F. and 1000 psig, to continue the extraction process. A plurality of lamellae 420 are present within the vessel 418 to continue the thickening and extraction process. By maintaining supercritical conditions within the vessel 418, the vessel 418 may be considerably smaller in size compared to a decantation vessel for a non-supercritical, e.g. retorting process. The reduction in size is due to both a decrease in the specific gravity of the solvent at supercritical conditions, and to a significant reduction in the viscosity of the fluid under supercritical conditions wherein the viscosity approaches that of a gas. Conversion of kerogen to bitumen is primarily accomplished in the autoclave 310, and secondarily in the extraction means. Within the vessel 418, the extracted bitumen is solubilized with the solvent to form an extract phase which separates from the solid components in the slurry. The vessel 418 includes an upper vapor outlet 421, an intermediate extract outlet 422 and a lower solids outlet 424. A predominant portion of the extract which separates from the solids within the extraction means exists the extract outlet 422 of the extraction vessel 418. Reacted and partially reacted solids exit the solids outlet 424 and are charged to the solvent washing means. For improved efficiency, the extraction means may include an additional vessel (not shown), smaller than and coupled to the vessel 418 about the extract outlet 422. This vessel will primarily separate vapors from the extract in the slurry and will eliminate the need for a vapor outlet 421 of the vessel 418.

The extraction means takes advantage of the supercritical temperatures and pressures to speed the separation of solid fines from the bitumen and solvent. The reduced specific gravity and viscosity of the fluid allows the fine particle solids to settle faster than at regular atmospheric pressures. Thus, the separation process is accomplished with greater speed. The faster separation means that the vessels 310 and 418 can be of smaller size. The reduction in size off-sets the cost required to make the vessels of greater thickness to accommodate the greater pressures.

Extract emerging from the extract outlet 422 is delivered to the solvent recovery means wherein the extract enters a standard multi-plate distillation column 510, having an upper solvent outlet 511, a lower stripped bitumen outlet 512, a vapor inlet 513, and a lower extract inlet 514. Extract from the vessel 418 is charged to the column 510, and solvent is flashed off. The column 510 is maintained at a lower pressure than the vessel 418, approximately 500 psig or lower. This lower pressure results in a decrease in solubility causing the solvent to exit as a vapor. Pressure relationships between the high pressure extraction means and the lower pressure solvent recovery means are maintained by a pressure valve 516 interposed between the outlet 422 and the extract inlet 514. Vapor from the outlet 421 may also be fed into the vapor inlet 513 of the column 510 via a pressure valve 517. A bottom portion of the stripped bitumen oils emerging from the outlet 512 are heated in a heat exchanger 518 and reintroduced to the column 510. The temperature of the extract is increased to approximately 550° F. and returned to column 510. The remaining extract emerging from column 510 enters the upgrading means Solvent emerges as a vapor from the solvent outlet 511 and is conducted to the preheat heat exchanger 219 to heat the slurry emerging from the mixer 212 to a temperature of approximately 450° F. The hot solvent is in turn cooled to about 250° F. by the slurry within the preheat heat exchanger 219, and is then cooled further in a heat exchanger 520 to approximately 150° F. before being fed to a knock-out drum 522. Within the knock-out drum 522, the solvent is separated from water by density. This water may be sour water by virtue of sulfurous products found in the conversion vessel 418. A portion of the solvent component is pumped to the solvent washing means to extract further bitumen from the pyrolyzed shale. The remaining solvent is heated in a heater 524 to assist in heating the slurry in the conditioning means, combined with solvent recovered in the desolventising means and pumped to the slurry mixer 212 to again contact incoming oil shale ore.

Figure 3:
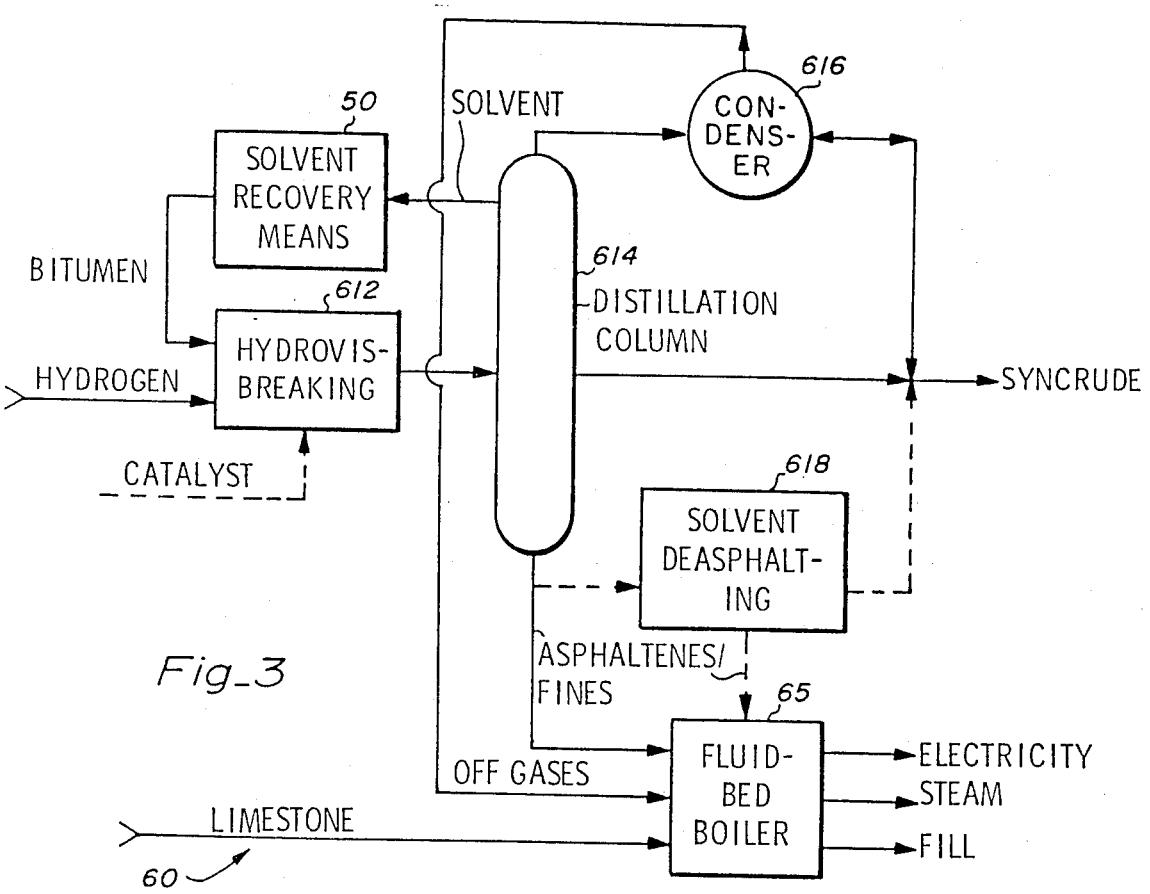
FIG. 3 is a detailed schematic diagram of the upgrading means of FIG. 1.

The upgrading means 60 is illustrated in detail in FIG. 3 and includes a hydrovisbreaking step 612 wherein the bitumen oils from the extract outlet 512 of the solvent recovery means 50 are reacted with a flow of hydrogen, with or without a catalyst, at pressures in the range of about 600 psig to 3000 psig and temperatures between 650° F. and 1000° F. The preferred pressure and temperature are about 1000 psig and 800° F. to 850° F., respectively, with a residence time of thirty to ninety minutes. The resultant crude enters a distillation means 614, e.g. a distillation column, wherein the crude is distilled to yield a light fraction, including off-gases, an intermediate syncrude cut, and an asphaltenes residue. A light solvent fraction may also be withdrawn from the distillation means 614 and can be returned to the solvent recovery means 50.

The light fraction from the distillation means 614, including one to five carbon hydrocarbons, is charged to a condenser 616 where the off-gases are removed, and the remaining hydrocarbons are combined with the intermediate syncrude fraction to yield a high grade, pipelineable synthetic crude oil product.

The asphaltenes residue, including fines, is charged to the fluid bed boiler means 65, together with a flow of off-gases from the condenser 616 and a flow of limestone to neutralize the gases and provide acceptable emission levels. The fines are removed in a bag house or wet scrubber (not shown) associated with the boiler means 65 after the residue is burned to yield processed heat and power.

An alternative mode of operation of the upgrading means 60 is to include a solvent deasphalting step 618 (represented by the dashed box in FIG. 3) to upgrade the residue and further increase the yield of pipelineable crude. In this mode, the hydrovis-breaking step 612 is operated at a lower severity, and the solvent deasphalting step 618 is employed to upgrade the asphaltene's residue. A lower severity means less reaction takes place due to a shorter time period, lower temperature or lower hydrogen pressure. The deasphalting step may use a number of alphatic, alicyclic or aromatic light hydrocarbon solvents as is known in the art. Examples of solvents include pentane or hexane, and the deasphalting may occur either above or below supercritical conditions for the solvent chosen. Asphaltenes residue plus fines remaining after the oil is extracted, enter the fluid bed boiler means 65 as before.

In crude converted kerogen or heavy oil where the fines do not act as a catalyst, it may be necessary to add a catalyst to the hydrovisbreaking means 612. Typical catalysts include vanadium sulphide, zeolites and liquid catalysts, including alkaline metal hydrosulphides. Crude bitumen resulting from the catalytic hydrovisbreaking is put into the distillation means 614 and the residue, defined as the plus 1050° F. fraction, is fed to the boiler means 65. The remaining fractions from the distillation means 614, i.e., the minus 1050° F. fractions, are the pipelineable synthetic crude oil product. It may be noted that the hydrovisbreaking implementation of the upgrading means 60 can successfully upgrade bitumen oils having a high percentage of fines, e.g., greater than three to four percent.

Figure 4:
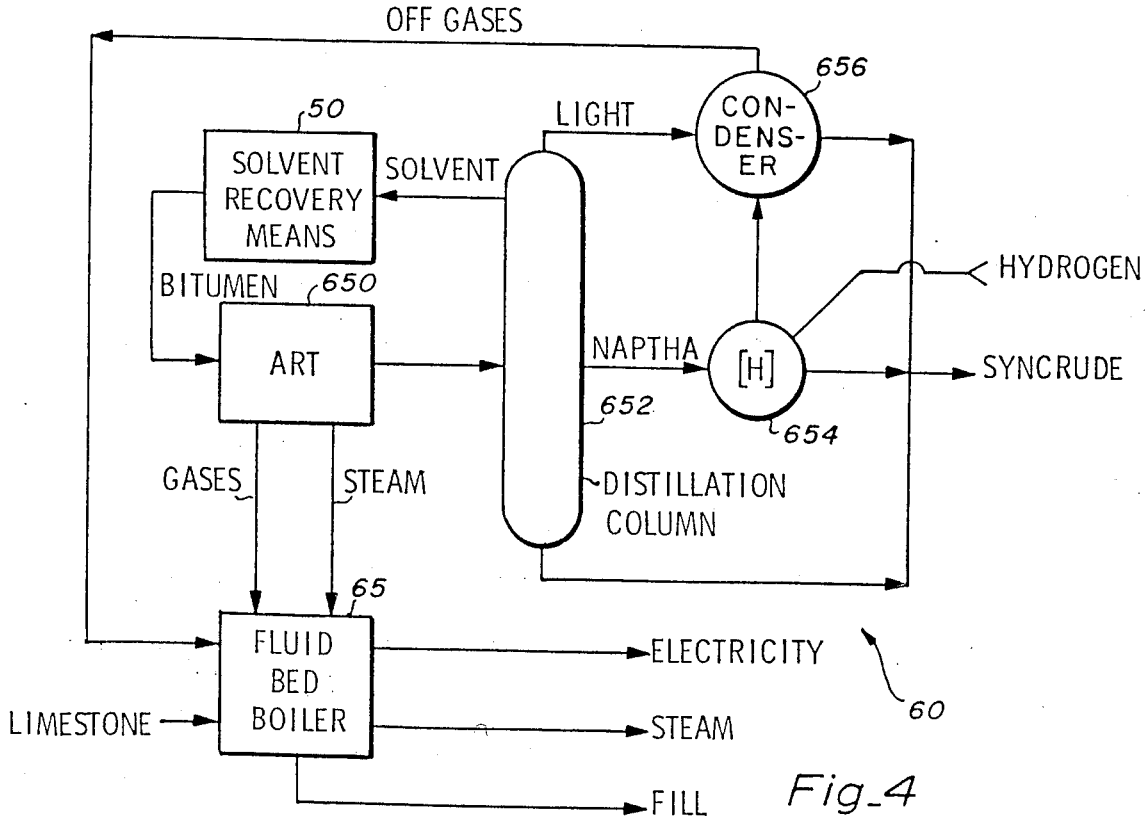
FIG. 4 is a detailed schematic diagram of an alternative embodiment of the upgrading means of FIG. 1.

FIG. 4 illustrates an alternative implementation of the upgrading means 60 of the process 10, and includes a proprietary process known as ART, represented by the block 650. The ART process 650 involves the deposition of carbon from the bitumen oils onto a catalyst. Such catalyst is typically one sold under the proprietary name ARTCAT. The carbon is then separately burned off in a catalyst regenerator. The velocity of air used in burning the carbon will aid in removing the fines fraction from the fine gases, which enter the fluid bed boiler means 65. Bitumen oils which have been reduced in fines and asphaltenes content by the ART process 650 are fed to a distillation means 652, which may comprise, for example, a distillation column. The column 652 separates the oils into four fractions; a lower syncrude fraction, an intermediate naptha fraction, a light solvent fraction, and a light fraction. The light solvent fraction may be charged to the solvent recovery means 50 for recycling. The naptha fraction is hydrogenated in a hydrogenation means 654 to stabilize the fraction and combine it with the syncrude fraction as a product. The light fraction, comprising one to five carbon hydrocarbons and volatile off-gases passes through a condenser 656 which removes the off-gases. The removed gases are burned in the boiler means 65, together with a supply of limestone to insure sulphur capture and suppression of oxides of nitrogen. The remaining hydrocarbons from the light fraction are combined with the stabilized naptha and syncrude fractions and exit the means 60 as a high grade, pipelineable syncrude product.

Within the solvent washing means 70, shale from the extraction means 40 enters a first pressure decanter 712. The shale exiting the solids outlet 424 of the extraction vessel 418 passes through a heat exchanger 714 wherein the shale is cooled to about 550° F. prior to entry into the first decanter 712. The solids are then charged to a solids inlet 716 of the first decantation vessel 712. The decantation vessel 712 also includes a solvent inlet 718 positioned opposite the solids inlet 716. The vessel 712 includes an upper solvent outlet 720 and a lower solids outlet 722. A second decantation vessel 730 receives shale from the outlet 722 at a shale inlet 732 and also receives a flow of solvent at a solvent inlet 734. The second decantation vessel 730 also includes a lower shale outlet 736 and an upper solvent outlet 738. Shale flows but of the outlet 736 and into a shale inlet 739 of the third decantation vessel 740, which also includes a solvent inlet 742, a shale outlet 744 and a solvent outlet 746 formed to the bottom and top of the decantation vessel 740, respectively. Solvent flowing out of the outlet 746 of the third decantation vessel 740 flows into the solvent inlet 734 of the second decantation vessel 730. Solvent flowing out of the solvent outlet 738 of the solvent decantation vessel 730 flows into the solvent inlet 718 of the first decantation vessel 712. The flow of solvent is thus countercurrent to the flow of shale within the solvent extraction means 70. Fresh solvent is supplied to the third decantation vessel 740 from the solvent recovery means 50.

Each of the three decanters 712, 730 and 740, are similar in construction, comprising a capsule-shaped pressure vessel having a plurality of internal lamellar thickeners 750 which provide a mixing/settling function and act to increase a surface-to-volume ratio of each decanter to improve washing efficiency while minimizing equipment size requirements. Extract, comprising bitumen plus solvent, exits the extract outlet 720 of the first decantation vessel 712 and is charged to the heat exchanger 714 to be heated by hot shale exiting the solids outlet 424 of the extraction vessel 418. The heated extract is combined with the flow of hot extract emerging from the outlet 422 of the extraction means 40 to be delivered to the extract inlet 514 of the solvent recovery means 50. A pressure valve 755 is interposed between the heat exchanger 714 and the extract inlet 514 to maintain pressure relationships between the solvent washing means 70 and solvent recovery means 50.

Solids, comprising spent shale plus a mixture of some solvent and water, exit the solids outlet 744 of the solvent extraction means 70 and enter, via a pressure valve 811, a separation vessel 812, of the desolventising means 80, wherein the solvent is separated from the shale. The vessel 812 is pressurized to about 100 psig, which is substantially less than that of the vessel 740, thus the heated solvent and water mixture flash off upon encountering the lower pressure environment of the vessel 812. The flashed off solvent and water mixture is fed through a condensor 814 and cooled to approximately 150° F. The cooled mixture enters an oil/water separator 816 wherein solvent and water are separated according to their densities. Hot spent shale exits the bottom of the vessel 812 and is introduced into a rotary drum 818, within which the pressure is fully reduced to atmospheric. A water spray, utilizing water recovered from the separator 816, is added to the drum 818 to further cool the spent shale and also insure complete solvent recovery. Sufficient water is added to the shale and the drum 818 so that the shale which enters the drum 818 at a temperature of between about 300° F. and 400° F. is cooled to be safe to touch, typically about below 140° F. and will exit the drum 818 as a damp mass. Most of the added water is converted to steam by the hot shale, and aids in stripping solvent and off-gases from the shale. Solvent and water vapors produced by heat absorption within the drum 818 as well as off-gases are withdrawn via a vapor outlet 820 and cooled in a condenser 822. The cooled water and solvent condense and are collected in a drum 824, and are pumped to the oil/water separator 816 for separation. The off-gases do not condense, and exit the drum 824 to be neutralized in the fluid bed boiler means 65, along with off-gases from the condenser 814.

Cool water for the condensers 217, 520, 814 and 822 is provided by a cooling tower 826. Cool water may also be provided as needed to apparatus within the upgrading means 60 and the fluid bed boiler means 65. Hot water from the condensers is returned to the cooling tower 826 and evaporatively cooled therein. It is to be noted that the condenser 822 may be an independent piece of apparatus, or it may be incorporated into the cooling tower 826. Solvent exiting the oil/water separator 816 is returned to the slurry mixer 212 to again contact oil shale to form the slurry.

In summary, the present invention provides a process for the extraction of oil from oil shale. Kerogen is converted at high temperature and pressure to bitumen, oil and gas, which are soluable in a high pressure supercritical solvent. The shale decrepitates to ten micron particles. The spent shale is then separated from the hydrocarbons by a countercurrent decantation with fresh solvent at lower pressure, followed by flashing off the solvent from spent shale at low or near atmospheric pressure.

The inventors have made approximately fifteen batch runs in which oil shale is treated with toluene under supercritical conditions ranging up to 400° C. and 1200 psia pressure. The results have shown recovery of up to one hundred and twenty percent of Fischer Assay of hydrocarbons. The Fischer Assay was developed for the oil shale industry to determine the efficiency of oil extraction processes. The Fischer Assay measures the recovery ratio of hydrocarbons from the oil shale. In a retorting process of the prior art, a Fischer Assay recovery of eighty to one hundred percent is typical, with recoveries exceeding one hundred percent difficult to achieve. The present invention thus achieves a better efficiency than the prior art retorting processes. These batch runs have demonstrated the potential for development of the process of this invention.

In the batch runs, oil shale has been slurried in toluene in a batch stirred reactor and heated to temperatures up to 400° C. and held for periods ranging from zero minutes up to two hours time. Examination of the spent shale which was produced from shale initially crushed to minus twelve mesh showed organic carbon reduction from twenty to 3.68 percent. Particle size distribution was 20.1 percent greater than eighty mesh with one hundred percent of the remainder less than forty-four microns.

Other data shows that at longer reaction times, an increase in residual organic carbon to more than five percent is obtained, indicating that secondary reactions of thermal cracking of primary reaction products is taking place. Based on this data obtained, it is anticipated that the required residence times will be less than thirty minutes and possibly as little as five minutes.

The advantages of the present process include the following: improved yield, easier control of fines minimizing dust problems, limiting water use to that required for spent shale disposal, less solids expansion due to no evaporation within particles, less gas production, control of product slate through choice of residence time/temperature relations, and production of nonfuel products, such a road asphalt. The present invention makes these advantages possible because of its new approach to shale oil production, namely converting the kerogen to bitumen and lighter products within an extraction medium.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as cover all alterations and modifications as fall within the true spirit and scope of the invention.

We claim:

1. A process for extraction of bitumen oil from oil shale in steps comprising:

a. crushing a quantity of oil shale ore to yield particles.

b. mixing the crushed ore with a quantity of organic solvent to form a slurry, the solvent being at a temperature sufficient to strip out water from the slurry;

c. transferring the slurry to a conversion means and allowing the ore to decrepitate under solvent supercritical temperatures and pressures for a time period whereby kerogen in said slurry is converted to a solvent soluble quantity of bitumen oils;

d. transferring the slurry to an extraction means under said supercritical temperatures and pressures and allowing further reaction whereby further production of bitumen oils occurs and the bitumen oils dissolve in said solvent to form an extract phase, leaving a solids phase comprising shale;

e. transferring said solids phase to a solvent washing means and washing said solids with fresh solvent in a countercurrent fashion under said supercritical temperatures and pressures, whereby further extract is produced, leaving spent shale;

f. withdrawing said extract from the extraction and solvent washing means, and transferring said extract to a distillation column having pressure below supercritical, thereby stripping the solvent therefrom to yield bitumen oils and recycling the solvent; and g. withdrawing a quantity of spent shale and solids from the solvent washing means, and h. desolventising said shale and recycling said solvent by passing said spent shale and solids through a separator vessel at a pressure below supercritical such that the solvent and water is flashed off from the shale, passing said flashed off solvent and water through a condenser and separator such that the solvent is separated from the water, taking the shale component from the separator vessel and passing it through a rotary drum at atmospheric pressure, adding water to the shale, the shale being at a temperature such that steam is produced which strips any remaining solvent from the shale and cools the shale.

2. The process of claim 1 wherein, said supercritical temperatures are between approximately 500° F. and 900° F. and pressures are in the supercritical regions for the solvent chosen.

3. The process of claim 1 wherein, the oil shale ore is crushed to a particle size suitable for slurry pumping, the solvent is toluene, the temperature is approximately 700° F. and the supercritical pressure is above approximately 900 psig.

4. The process of claim 3 wherein, said predetermined time period is approximately twenty minutes.

5. The process of claim 1 wherein, the conversion means comprises a pressure reactor vessel having an internal venturi draft tube, a lower shale outlet and an intermediate extract outlet.

6. The process of claim 1 wherein, the extraction means comprises a pressure vessel having at least a shale outlet, an extract outlet and having a plurality of internal lamellar thickeners.

7. The process of claim 1 wherein, the solvent washing means comprises at least a first and a second decantation vessel, each having at least an extract outlet, a shale inlet, a shale outlet, a solvent inlet and a plurality of internal lamellar thickeners, said shale outlet and said solvent inlet of said first decantation vessel being coupled to said shale inlet and an extract outlet, respectively, of said second decantation vessel whereby shale and extract move in countercurrent relationship to one another within the means, said first decantation vessel receiving a flow of shale from said extraction means.

8. The process of claim 1 wherein, said bitumen oils are upgraded to produce a synthetic crude oil following the solvent removal.

9. The process of claim 8 wherein said upgrading includes, a. hydrovisbreaking said bitumen oils at elevated temperatures and pressures, in the presence of hydrogen, to yield synthetic crude;

b. distilling the resulting synthetic crude to yield off-gases, an intermediate syncrude fraction and a heavy asphaltenes residue, said asphaltenes residue including fines; and c. withdrawing the intermediate fraction as product, and stripping a quantity of light hydrocarbons from said off-gases to yield further product.

10. The process of claim 9 wherein, said hydrovisbreaking step includes addition of a catalyst.

11. The process of claim 9 wherein, said asphaltenes residue is burned in a fluid bed boiler wherein process heat and power is obtained.

12. The method of claim 9 wherein, said asphaltenes residue is deasphalted using a solvent deasphalting process, to extract additional syncrude therefrom prior to burning said residue.

13. A process for the extraction of bitumen oils from oil shale comprising:

crushing oil shale ore to a particle size suitable for slurry pumping;

slurrying the crushed oil shale with an organic solvent in a slurry mixer means, the solvent temperature being sufficient to strip out water from the slurry;

heating and transferring the slurry to a high pressure autoclave means where the slurry is subjected to solvent supercritical temperatures and pressures and allowing the solvent to react with a quantity of kerogen containing materials in the slurry for a period of approximately twenty minutes, whereby kerogen within the oil shale is converted to bitumen and the bitumen is solvated by the solvent;

drawing off an extract comprising bitumen oils plus solvent into a high pressure extraction vessel having a plurality of internal lamellar thickeners, subjecting said extract to supercritical temperatures and pressures, and separating the extract into a solids component and a bitumen oil/solvent component;

transferring the solids component to a multi-stage countercurrent solvent washing means, the means being maintained at said supercritical temperatures and pressures to further extract bitumen oils from the shale;

transferring an extract phase comprising solvent plus bitumen oils from the extraction and solvent washing means to a fractionation column, at a pressure below supercritical pressures, such that the solvent is flashed off and separated from the bitumen oils;

upgrading the extracted bitumen oils to produce a substantially purified synthetic crude oil product and an asphaltenes residue;

collecting and recycling the solvent and collecting and desulphurising off-gases generated by the process; and withdrawing a quantity of spent shale and solids from the solvent washing means, and desolventising said shale and recycling said solvent by steps comprising passing said spent shale and solids through a separator vessel at a pressure below supercritical, such that the solvent and water is flashed off and separated from said solids component, passing said flashed off solvent and water through a condenser and separator such that solvent is separated from the water, taking the solids component from the separator vessel and passing it through a rotary drum at atmospheric pressure, adding water to the solid component, the solid component being at a temperature such that steam is produced which strips any remaining solvent from the solids component and cools the solvent component.

14. The process of claim 13 wherein, said supercritical temperatures are between approximately 500° F. and 900° F. and pressures are in the supercritical regions for the solvent chosen.

15. The process of claim 13 wherein, the oil shale ore is crushed to a particle size suitable for slurry pumping, the solvent is toluene, the temperature is approximately 700° F. and the supercritical pressure is above approximately 900 psig.

16. The process of claim 13 wherein, the solvent washing means comprises at least a first and a second decantation vessel, each having at least an extract outlet, a shale inlet, a shale outlet, a solvent inlet and a plurality of internal lamellar thickeners, said shale outlet and said solvent inlet of said first decantation vessel being coupled to said shale inlet and an extract outlet, respectively, of said second decantation vessel whereby shale and extract move in countercurrent relationship to one another within the means, said first decantation vessel receiving a flow of shale from said extraction means.

17. The process of claim 13 wherein said upgrading step includes, a. hydrovisbreaking said bitumen oils at elevated temperatures and pressures, in the presence of hydrogen, to yield synthetic crude;

b. distilling the resulting synthetic crude to yield off-gases, and intermediate syncrude fraction and a heavy asphaltenes residue, said asphaltenes residue including fines; and c. withdrawing the intermediate fraction as product, and stripping a quantity of light hydrocarbons from said off-gases to yield further product.

18. The process of claim 17 wherein, said hydrovisbreaking step includes addition of a catalyst.

19. The process of claim 17 wherein, said asphaltenes residue is burned in a fluid bed boiler wherein process heat and power is supplied.

20. The method of claim 17 wherein, said asphaltenes residue is deasphalted using a solvent deasphalting process, to extract additional syncrude therefrom prior to burning said residue.

* * * * *

UNITED STATES PATENT AND TRADEMARK OFFICE

CERTIFICATE OF CORRECTION

PATENT NO. : 4,737,267

DATED : April 12, 1988

INVENTOR(S) : Sun-Sea Pao; Jerry V. Fox; John S. Rendall

It is certified that error appears in the above—identified patent and that said Letters Patent is hereby corrected as shown below:

Column 1, line 35, change "3%" to --30%--;
Claim 4, after "approximately" add -one to--; and
Claim 13, line 17, after "approximately" add --one to--.

Signed and Sealed this

Fourth Day of October, 1988

*Attest:*

DONALD J. QUIGG

*Attesting Officer*

*Commissioner of Patents and Trademarks*